US007195181B2

(12) United States Patent
Steingass et al.

(10) Patent No.: US 7,195,181 B2
(45) Date of Patent: Mar. 27, 2007

(54) DISC FOR MOVING SLIDE VALVE

(75) Inventors: Robert W. Steingass, Valparaiso, IN (US); David E. Kim, Valparaiso, IN (US); William I. Thompson, Hobart, IN (US)

(73) Assignee: Task Force Tips Inc., Valparaiso, IN (US)

( * ) Notice: Subject to any disclaimer, the term of this patent is extended or adjusted under 35 U.S.C. 154(b) by 519 days.

(21) Appl. No.: 10/744,512

(22) Filed: Dec. 23, 2003

(65) Prior Publication Data

US 2005/0133636 A1 Jun. 23, 2005

(51) Int. Cl.
*B05B 1/30* (2006.01)

(52) U.S. Cl. ..... 239/581.1; 239/71; 239/73; 239/456; 239/526; 239/583; 169/14

(58) Field of Classification Search ..... 239/71, 239/73, 452, 453, 456, 525, 526, 538, 581.1, 239/581.2, 583; 169/14; 251/101, 102, 251/297; 137/331, 333
See application file for complete search history.

(56) References Cited

U.S. PATENT DOCUMENTS

| | | | | | |
|---|---|---|---|---|---|
| 2,619,351 | A * | 11/1952 | Kennedy | ..... | 369/212 |
| 2,753,219 | A * | 7/1956 | Matarese | ..... | 239/456 |
| 2,806,741 | A * | 9/1957 | Fishelson | ..... | 239/456 |
| 4,470,549 | A * | 9/1984 | McMillan et al. | ..... | 239/583 |
| 4,589,439 | A | 5/1986 | Steingass | | |
| 4,653,693 | A * | 3/1987 | Steingass | ..... | 239/456 |
| 5,312,048 | A * | 5/1994 | Steingass et al. | ..... | 239/452 |
| 6,354,320 | B1 * | 3/2002 | Kolacz et al. | ..... | 239/581.1 |

* cited by examiner

*Primary Examiner*—Steven J. Ganey
(74) *Attorney, Agent, or Firm*—McDermott Will & Emery LLP

(57) ABSTRACT

The invention is an improvement in a disc and a handle for the receiver section of a fire fighting nozzle. Together, this disc and handle facilitate the opening and closing of a fire nozzle assembly, for permitting and preventing, respectively, the discharge of fire extinguishing fluids from that nozzle. The improvement of the present invention results from the use of a one-piece disc with generally resilient arms, and from the use of a plastic handle with a generally oblong shaped slot.

7 Claims, 5 Drawing Sheets

DISC FOR MOVING SLIDE VALVE

TECHNICAL FIELD

This invention relates to an improved disc for moving a slide valve used in a fire fighting nozzle.

BACKGROUND OF THE INVENTION

Valves for use with various kinds of fire apparatus are well known in the art. Such valves are used to direct fire extinguishing fluids, such as water and water-foam combinations, onto fires. Such valves may be, for example, attached to the ends of hoses that are transported by fire pump trucks. Many different kinds of fire fighting nozzles are known in the art. One example of a fire fighting nozzle is shown and described in U.S. Pat. No. 4,589,439 ("the '439 patent"). The '439 patent issued to Robert W. Steingass on May 20, 1986, and was assigned to Task Force Tips Incorporated, the assignee of the present application.

The '439 patent describes a fire fighting nozzle that includes a receiver section and a coaxial, tubular body section. A flow control valve assembly is enclosed within the receiver section and the tubular body section. As may best be seen in FIGS. 1–3 of the '439 patent, the flow control valve assembly includes a tubular sliding valve member which is reciprocally and rotatably mounted in the receiver section. The tubular sliding valve member moves towards and away from a valve seat.

When moved in a forward direction, the tubular sliding valve member is moved into an abutting relationship with the valve seat. This prevents the discharge of fluid from the nozzle. In contrast, when the tubular sliding valve member is moved in a rearward direction, the valve member is moved out of abutting relationship with the valve seat. In this rearward position, an annular opening is formed between the valve member and the valve seat. The fluid can then be discharged through this annular opening.

This forward and rearward movement of the sliding member is initiated by the corresponding forward and rearward movement of a handle. The handle is secured to the receiver section by means of a disc that is contained within a mating bore formed in the receiver section. One such disc is shown in FIGS. 5 and 7 of the '439 patent, and its mating bore is shown in FIG. 6 of the '439 patent. Other functionally similar discs are used in connection with other, current fire fighting nozzles. These discs, one of which is depicted as Prior Art in FIG. 2A of this specification, have certain deficiencies.

For example, the Prior Art disc shown in the attached FIG. 2A includes a pair of drag nubs, both of which are shown on the right side of that Figure. These drag nubs are spaced one hundred and eighty degrees apart from each other. Each of these drag nubs is contained in one of two separate radial cavities extending from, and formed between, a central hole of the disc and the perimeter of the disc. When a trunnion screw is inserted into this central hole and fastened to the disc, the tapered end of the screw pushes or "cams" the drag nubs radially outwardly, and into contact with the walls of the mating bore in the receiver section of a fire fighting nozzle assembly.

A handle is used to move the slide valve into and out of engagement with the valve seat. The handle is attached to a disc, and the movement of the handle coincides with rotation of the disc. Friction created by the contact between the drag nubs and the walls of the mating bore is desirable. That friction creates the sensation of a drag on the handle when it is moved in a forward or rearward direction, providing the handle with a sense of heft. Moreover, this drag helps to prevent the inadvertent and unintended movement of that handle. Such inadvertent movement can occur as a result of forces encountered in the rugged conditions of use, and as a result of the water pressures attributable to high water discharge volumes, that are typically encountered during fire fighting.

While such a prior art disc is generally reliable, failures occur in approximately two units annually per thousand units in the field. The failures occur as a result of the structures found in these discs. Specifically, these prior art discs are held in place with a retaining ring, as may also be seen in FIG. 2A. If the disc should fail in the field, its removal from the receiver section is virtually impossible. Even if it were possible, however, such removal would irreparably damage the retaining ring, the disc, and the receiver section. Specifically these prior art discs are permanently held in place with a captive retaining ring. Failure of the disc can occur if the handle is deformed by a severe blow. Rotating the handle can cause the disc to wear inside its bore, or against the retaining ring. The disc no longer rotates with the desired drag, as byproducts of the wear and subsequent corrosion accumulate. Such wear and corrosion can also cause the retaining ring to expand fully out of engagement with the groove on the disc. If this happens, the disc can move out of its mating bore, causing loss of engagement of the disc with the hollow receiver section. As a result, the valve cannot function. The practical result of these deficiencies is that any failure of the prior art disc requires that the entire hollow receiver section member be returned to the manufacturer, and replaced.

Thus, it would be desirable to design a new disc that would overcome the disadvantages of the current, prior art discs. It would also be desirable to design a disc that, when broken or defective, could be readily removed from the receiver section, and be replaced with a new disc.

SUMMARY OF THE INVENTION

The invention is an improvement in a disc and a handle for moving a slide valve of a fire fighting nozzle. Together, this disc and handle facilitate the opening and closing of a fire nozzle assembly, for permitting and preventing, respectively, the discharge of fire extinguishing fluids from that nozzle. The improvement of the present invention results from the use of a one-piece disc. The disc has at least one resilient, normally outwardly biased biasing means. Here, the preferred biasing means is one or two generally resilient arms. The improvement of the invention also results from the use of a novel plastic handle with a generally oblong shaped slot.

More particularly, the invention is a one-piece disc for insertion into a mating bore of a hollow member that is a component of the fire fighting nozzle assembly.

The novel disc includes a generally cylindrical disc body. That disc body has a nominal diameter, and a generally smooth perimeter. The disc body also has resilient, normally outwardly biased arms.

When the disc body is positioned outside of the mating bore, a portion of the arms extends beyond the nominal diameter of the disc body. In contrast, when the disc body is positioned within the confines of the mating bore, these resilient arms are biased inwardly by the periphery of the mating bore. The resilient arms are then compressed by the walls of the mating bore. As a result, the resilient arms are substantially contained within the nominal diameter of the disc body.

When the one-piece disc is placed within the mating bore, these resilient arms are compressed. However, their designed-in, normally outward bias results in a tendency of those arms to be biased back in the direction of their original position. As a result, when the one-piece disc is contained within the mating bore, the arms have a natural tendency to push outwardly and press against the peripheral walls of the mating bore. This pressing ensures a secure, frictional fit of the disc body within the mating bore. The disc body is preferably made of a plastic or nylon material, and can include a central orifice into which a threaded fastener may be inserted.

The hollow valve member of the fire fighting nozzle assembly has a plurality of recesses. A plastic handle includes an oblong slot, and that oblong slot contains a ball to engage the recesses. The oblong slot also includes a spring which biases that ball towards those recesses for that engagement. The oblong slot is constructed to permit movement of the ball in a generally upward and downward direction, while restricting movement of the ball in a generally side-to-side direction.

DETAILED DESCRIPTION

Figure 1:
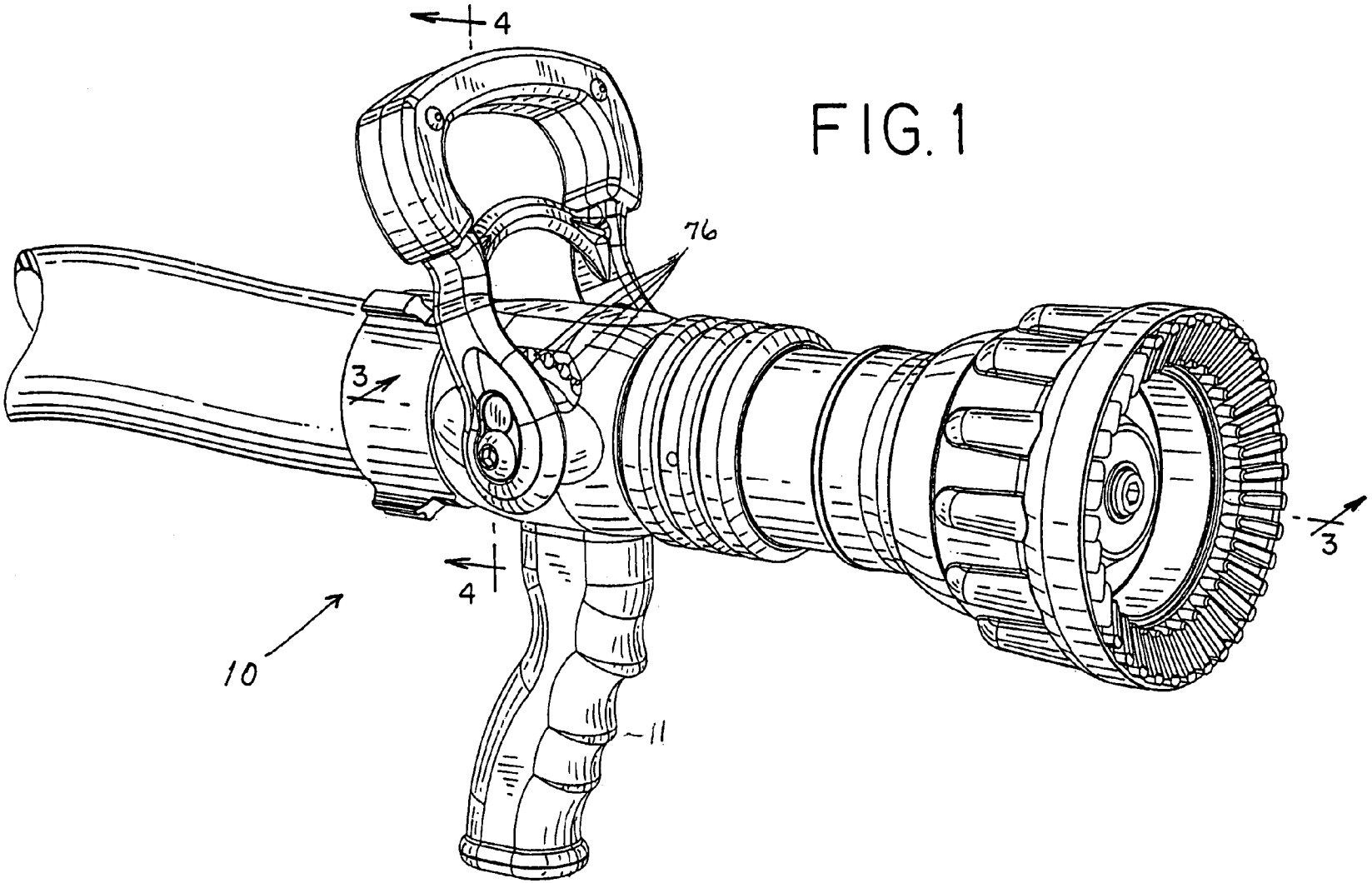
FIG. 1 is a perspective view of a fire fighting nozzle in accordance with the invention, with the handle moved in a rearward position so that the nozzle is opened.

The invention is an improvement in a disc and a handle for moving a slide valve of a fire fighting nozzle. FIG. 1 shows the environment of the fire fighting nozzle assembly 10 of the invention. This fire fighting nozzle assembly 10 is typically used by fire departments to dispense and accurately direct large volumes of water or other fire extinguishing fluids onto a fire.

The nozzle assembly 10 is generally held by the fireman. The nozzle assembly 10 may include grip 11 that can be held by the fireman. This grip 11 extends from the nozzle assembly 10 to allow the fireman to counteract and neutralize the reverse thrust caused by the discharge of large volumes of water from the nozzle assembly 10. As a result, the fire fighter has an easier time handling the nozzle assembly 10, and is better able to direct the fire extinguishing fluids to the desired location.

Figure 2:
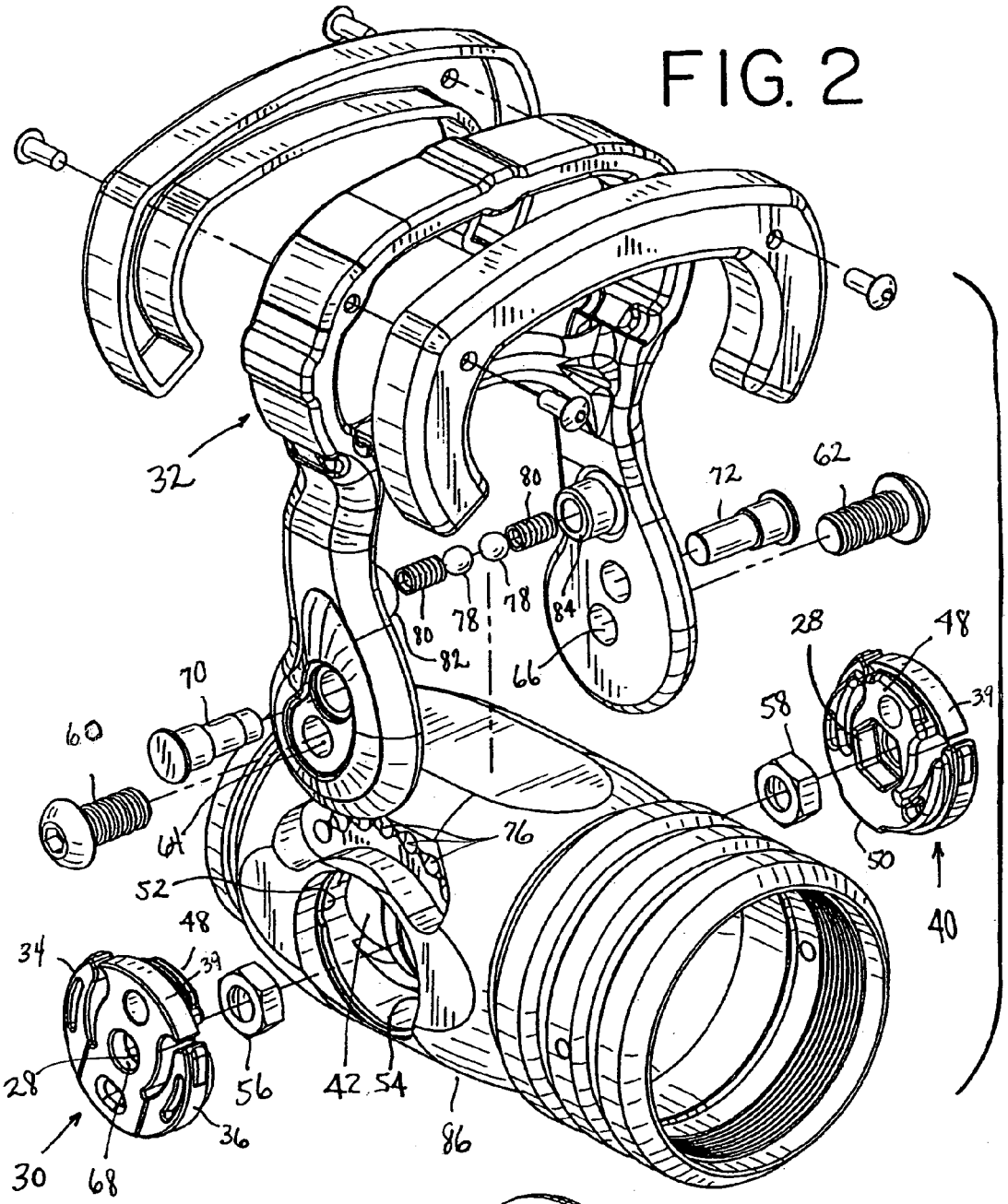
FIG. 2 is an exploded view of the receiver section portion of the fire fighting nozzle of FIG. 1.
Figure 2A:
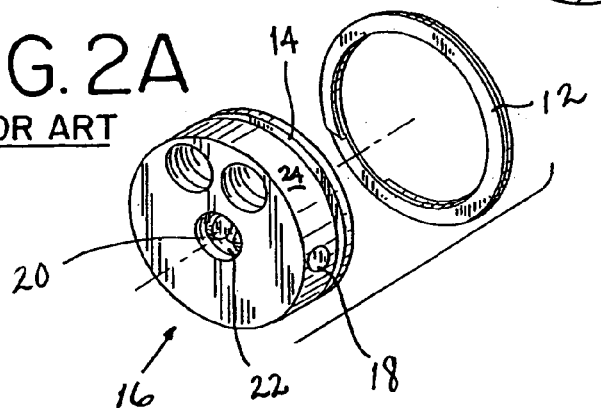
FIG. 2A PRIOR ART
FIG. 2A is a perspective view of a prior art disc and retaining ring.

FIG. 2A shows a prior art device. As may be seen in this FIG. 2A, the prior art disc 16 includes a pair of drag nubs 18 and 20. A retaining ring 12 fits into a groove 14 in the disc 16. The drag nubs 18, 20 are spaced one hundred and eighty degrees apart from each other. Each of these drag nubs 18, 20 is contained in one of two separate radial cavities (not shown) extending from a central hole 22 of the disc 16, and formed between that central hole 22 and the outer perimeter 24 of the disc 16. When a trunnion screw (not shown) is inserted into this central hole 22 and fastened to the disc 16, the tapered end of the trunnion screw pushes or "cams" the drag nubs 18, 20 radially outwardly, and into contact with the walls of the mating bore in the receiver section 86 of a fire fighting nozzle.

A handle is used to move the sliding member into and out of engagement with the valve seat. Because the handle is attached to this disc 16, movement of the handle coincides with rotation of the disc 16. Friction created by the contact between the drag nubs 18, 20 and the walls of the mating bore is desirable. That friction creates the sensation of a drag on the handle when it is moved in a forward or rearward direction, providing the handle with a sense of "heft." Moreover, this drag helps to prevent the inadvertent and unintended movement of that handle. Such inadvertent movement can occur as a result of forces encountered in the rugged conditions of use, and as a result of the water pressures attributable to high water discharge volumes, that are typically encountered during fire fighting.

These shortcomings of these and other prior art discs 16 are overcome by the present invention, which is centered around a disc 30. The construction of the fire fighting nozzle assembly 10 is highly similar to the construction of the assembly shown in U.S. Pat. No. 4,589,439, whose disclosures are incorporated by reference.

Figure 8:
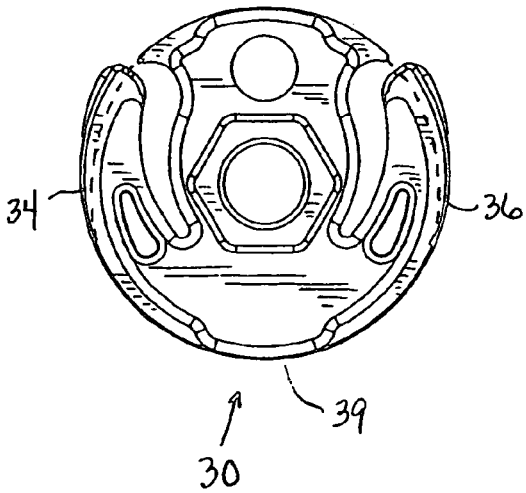
FIG. 8 is a side view of the disc in accordance with the invention, when that disc is positioned outside of the confines of the mating bore, and where at least a portion of the arms extends beyond the nominal diameter of the disc body.
Figure 9:
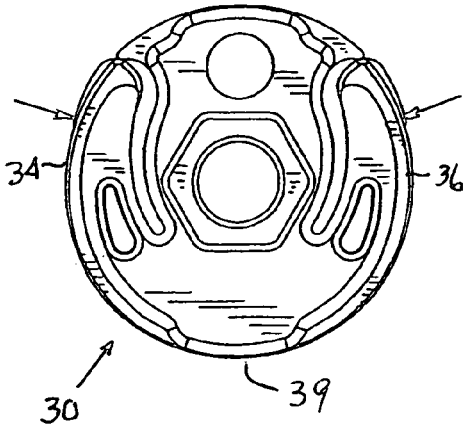
FIG. 9 is a side view of the disc in accordance with the invention, when that disc is positioned within the confines of, and biased inwardly by the periphery of, the mating bore, to a position where the arms are substantially within the confines of the nominal diameter of the disc body.

FIGS. 8 and 9 show the disc itself. FIGS. 2–4 and 6–7 show the disc 30 in the environment of its supporting components and structure.

As may be seen in FIG. 2, the fire fighting nozzle assembly 10 includes a handle 32. The handle 32 is secured to disc 30 and an identical disc 40. Together with many of these other components, including but not limited to handle 32, the disc 30 facilitates the opening and closing of the fire nozzle 10.

This pair of discs 30 and 40 are intended for insertion, respectively, into one of the two mating bores 42, 44. Mating bore 42 can be seen fully in FIG. 2, and mating bore 44 can be seen in FIG. 4. Mating bores 42, 44 are formed in opposite side walls of the generally hollow receiver section 86.

One side of disc 30 and disc 40 includes tabs 48 and 50. These tabs 48 and 50 permit the proper insertion of the discs 30, 40 into the bores 42, 44. In order to facilitate retention of discs 30, 40 within the receiver section 86, each disc 30, 40 has at least one resilient, normally outwardly biased biasing means. The biasing means may include one arm, but here preferably includes two arms 34 and 36. These arms 34 and 36 should be compressed in the direction of the arrows shown in FIG. 9. When inserting the discs 30, 40, the tabs 48, 50 are aligned with complementary shaped slots 52, 54 formed in the bores 42, 44. After alignment of the tabs 48, 50 with the slots 52, 54, the discs 30, 40 may be rotated to secure the discs 30, 40 within those bores 42, 44.

After the discs 30, 40 are secured within the bores 42, 44, those discs 30, 40 may rotate within those bores, subject to certain limits of rotation. Particularly, the discs 30 and 40 may be rotated between the two positions depicted in FIGS. 6 and 7, respectively. When the disc 30 is in the position shown in FIG. 6, the nozzle 10 itself is in the closed position, i.e., fluids cannot be discharged through the nozzle 10. In contrast, when the disc 30 is in the position shown in FIG. 7, the nozzle 10 is in the open position, i.e., fluids may be discharged through the nozzle 10.

Figure 3:
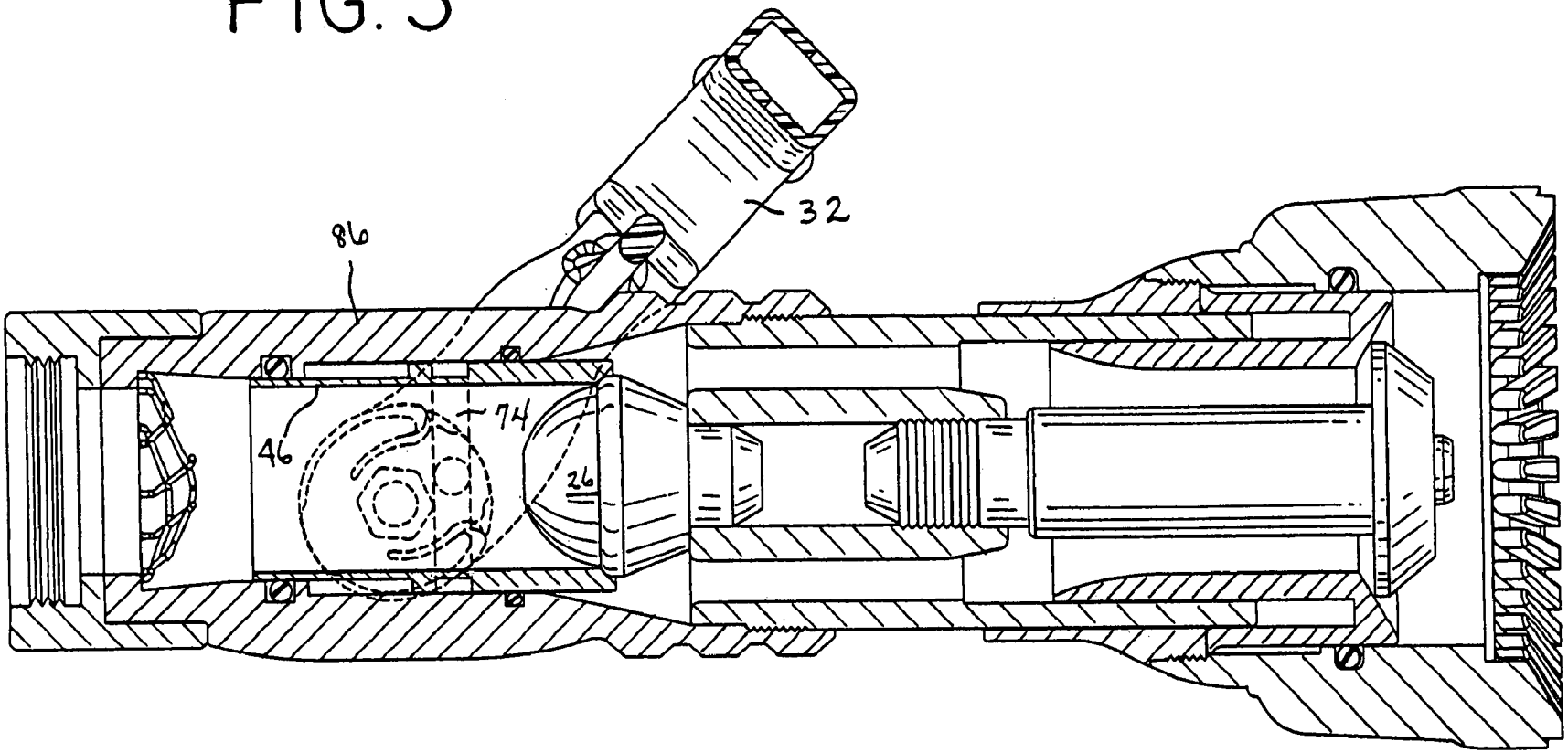
FIG. 3 is a sectional view of the nozzle of FIG. 1, with the handle moved forward to close the nozzle, and taken along line 3—3 of FIG. 1.
Figure 5:
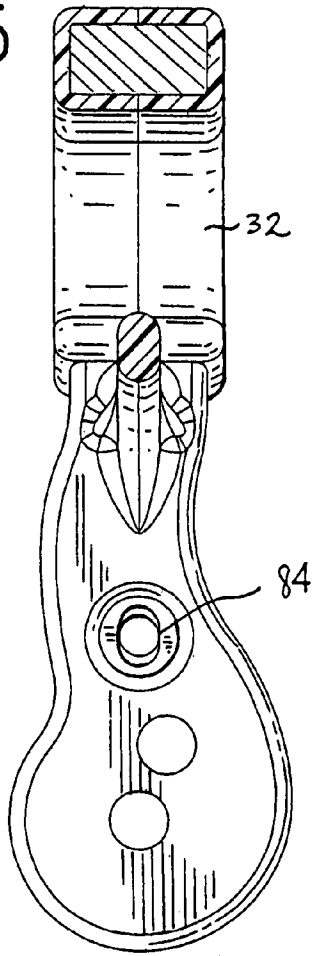
FIG. 5 is a view of the handle of FIG. 4, when viewed outwardly from the symmetrical center of that handle, and with the upper portion of the handle taken in section.

FIG. 3 shows the nozzle assembly 10 in its closed position, with the handle 32 moved forward, i.e., towards the discharge end of the nozzle 10. The opening and closing of the nozzle 10 results from the forward and rearward movement, along the axis of that nozzle 10, of the hollow slide valve member 46 shown in FIGS. 3 and 4. When handle 32 is in its forward position, as shown in FIG. 3, the slide valve member 46 is moved forward and engages the valve seat 26, preventing the discharge of fire extinguishing fluids from the nozzle 10.

In contrast, when the handle 32 is in its rearward position, as shown in FIG. 1, the slide valve member 46 is moved away from the discharge end of the nozzle 10, disengaging the slide valve member 46 from the valve seat 26, thereby permitting discharge of the fire extinguishing fluids from the nozzle 10.

Referring again to FIG. 2, the backside of the discs 30 and 40 include a central orifice 28 to receive threaded nuts 56 and 58. After the discs 30, 40 have been inserted into their respective mating bores 42, 44, the handle 32 may be secured to the discs 30, 40.

To secure that handle 32, trunnions 60, 62 are inserted through holes 64, 66 in the handle 32, and then through the central orifices 28 of the discs 30, 40. The discs 30, 40 are made of either a plastic or nylon material. As a result, for example, when the trunnion 60 is placed into the central orifice 28 of disc 30 and rotated in a clockwise direction, the rotation of that trunnion 60 forms self-tapped, conjugate resilient threads upon the nylon or plastic peripheral surface 68 of central orifice 28. Continued rotation of the trunnions 60, 62 causes them to engage the internally threaded nuts 56, 58 and in this way firmly secure the handle to the discs 30, 40. The resilient threads effectively prevent the trunnions 60, 62 from loosening up over time thereby obviating the need for a thread locking compound between the trunnions 60, 62 and the threaded nuts 56, 58.

Movement of the handle 32 forward, i.e., towards the discharge end of the nozzle assembly 10, moves the hollow slide valve member 46 into contact with the stationary valve seat 26, and closes the nozzle. When the nozzle 10 is closed, fire extinguishing fluids cannot be discharged. In contrast, movement of the handle 32 rearwards, i.e., away from the discharge end of the nozzle assembly 10, moves the hollow slide valve member 46 away from the stationary valve seat, and opens the nozzle 10. When the nozzle 10 is opened, fire extinguishing fluids may be discharged.

Figure 4:
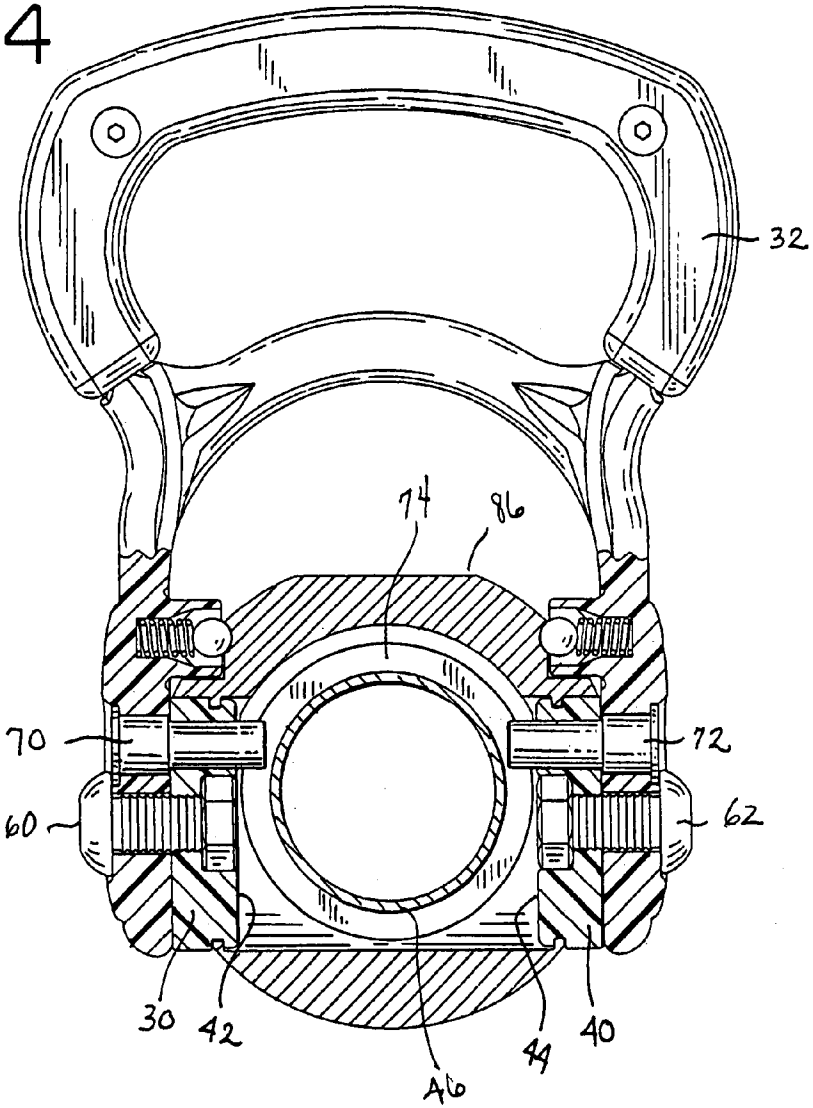
FIG. 4 is a sectional view of the handle and receiver section of the fire fighting nozzle, along with the contained slide valve, taken along line 4—4 of FIG. 1.
Figure 7:
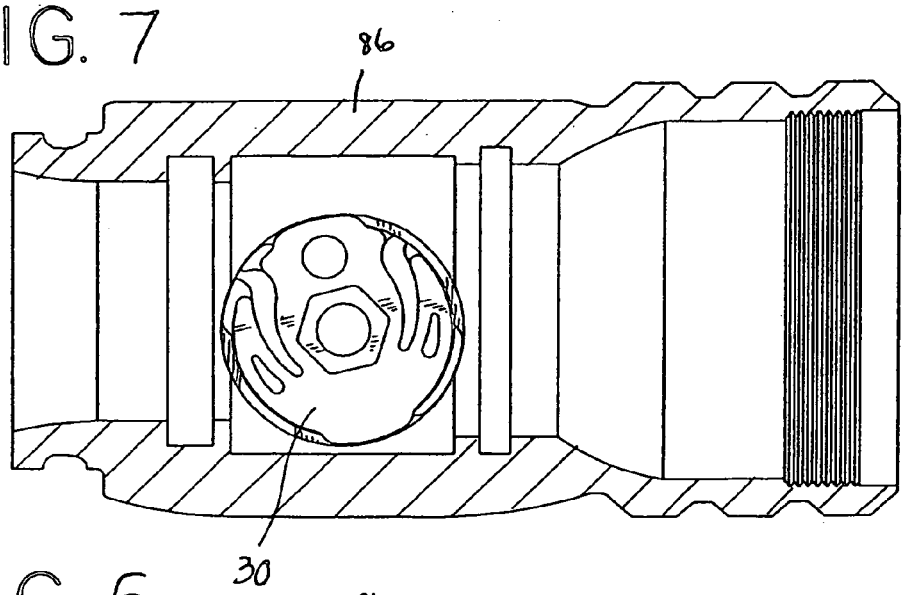
FIG. 7 is a side view of the receiver section of the fire fighting nozzle of FIG. 1, with the disc in the rotational position it would assume when the nozzle is in the open position.
Figure 6:
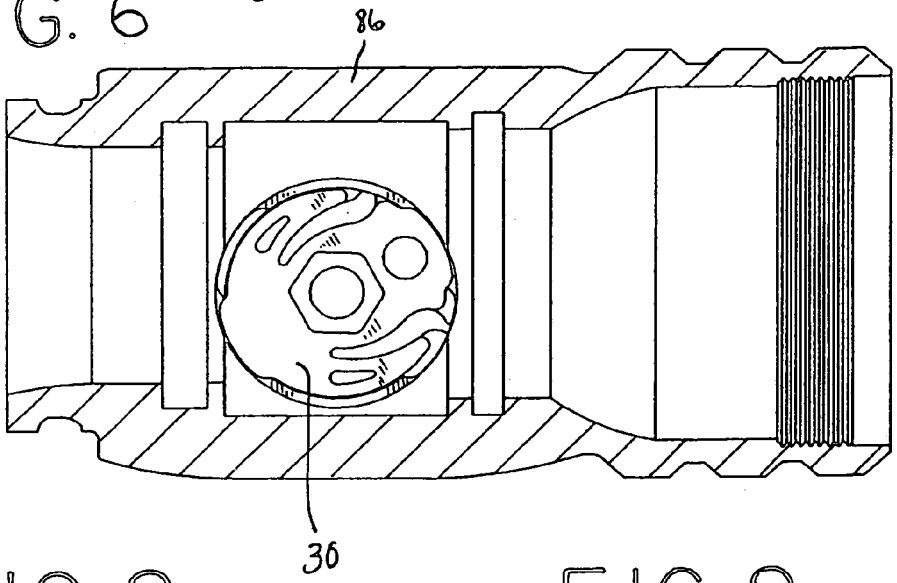
FIG. 6 is a side view of the receiver section of the fire fighting nozzle of FIG. 1, with the disc in the rotational position it would assume when the nozzle is in the closed position.

As may best be seen in FIG. 4, movement of the slide valve member 46 towards and away from the valve seat 26 arises by the contact of lugs 70, 72 with a circumferential groove 74 on the outer surface of the hollow slide valve member 46. The details of the structure described in this paragraph, and its operation, are known in the art, and are described at column 6 of the '439 patent, whose disclosures are incorporated herein by reference.

One of the improvements of the present invention results largely from the use of a one-piece disc 30. As a result of this improvement, a broken or otherwise damaged disc 30 can be replaced. The disc 30 of the present invention, if corroded, worn, or otherwise damaged, can be replaced. The disc 30 of the present invention also eliminates some of the problems and complications attributable to multi-piece discs, such as the prior art multi-piece disc shown in FIG. 2A.

As may best be seen in FIGS. 2 and 8, the disc 30 of the present invention has a generally cylindrical disc body, and generally resilient arms 34 and 36. This disc 30 may be injection molded, and is preferably made of either a plastic or a nylon material. The most preferred material is nylon-6.

In the preferred embodiment, the cylindrical disc 30 has a "nominal diameter" of approximately 1.58 inch. For the purposes of this invention, the term "nominal diameter" means the diameter of the disc body when it is outside of the mating bore 42, and exclusive of its generally resilient arms 36 and 38. The "nominal diameter" is shown in the dotted lines that circumscribe the disc body in FIG. 8. The "nominal diameter" of the disc shown in FIG. 8 is thus essentially the diameter of the disc body (i.e., the disc 30 without the arms) from the top to the bottom of the disc 30.

The preferred thickness of the cylindrical disc 30 is approximately 0.420 inch. The disc includes a generally smooth perimeter 39.

Discs 30 and 40 are identical. As noted above, disc 30 also has resilient, normally outwardly biased arms 34 and 36. The outwardly biased arms 34 and 36 have a cross section that is relatively thin. As a result, upon the application of force to the arms, at the point and in the direction depicted by the arrows of FIG. 9, the arms 34 and 36 tend to move inwardly. When such force is applied, the arms move towards the center of the disc 30, and to the position shown in FIG. 9. Such inward movement of arms 34 and 36 is necessary in order to permit the installation of the discs 30, 40 into the mating bores 42, 44. In this preferred embodiment, the amount of the force necessary to move these arms 34 and 36 inwardly is approximately 62 lbs-f.

Conversely, when that force is released, the arms 34 and 36 spring back, and return to their normal, outwardly biased position of FIG. 8. As may be seen in this FIG. 8, when the disc body 30 is in its normal state, as when it is positioned outside of the mating bore 42, a portion of each of the arms 34 and 36 extends beyond the "nominal diameter" (as shown in dotted lines) of the disc body 30.

In contrast, when the disc body 30 is positioned within the confines of the mating bore 42, these resilient arms 34 and 36 contact the periphery of the mating bore 42, and that contact contracts the arms 34 and 36 so that they are biased inwardly. The resilient arms 34 and 36 are then compressed into a position where they are substantially contained within the confines of the nominal diameter of the disc body 30.

In summary, when the one-piece disc 30 is placed within the mating bore 42, these resilient arms 34 and 36 are compressed. However, their designed-in, normally outward bias results in a tendency of those arms 34 and 36 to return to their original position. As a result, when the one-piece disc 30 is contained within the mating bore 42, the arms 34 and 36 have a natural tendency to push outwardly and press against the periphery of the mating bore 42. This pressing ensures a secure, friction fit of the disc body 30 within the mating bore 42. As a result of this friction fit, the typical torque necessary to turn these discs 30, 40 when they are within their mating bores 42, 44 is approximately 19 in-lbs-f.

Referring now to FIGS. 1 and 2, the receiver section 86 of the fire fighting nozzle assembly 10 has a plurality of recesses 76. The recesses 76 work with components in the handle 32 to secure the position of the handle 32. In this embodiment, the receiver section 86 has fourteen recesses 76, seven recesses 76 on each of two sides of the receiver section 86. Thus, the seven recesses 76 permit the nozzle 10 to be in either a fully opened (full flow) or closed (no flow) position, or in one of five intermediate, partial flow positions.

One of the seven recesses 76 on each side of the receiver section 86 will be engaged by an adjacent ball 78, of two separate ball 78 and spring 80 combinations on each arm of the handle 32. Each of the two ball 78 and spring 80 combinations are captured in one of the two oblong slots 82 and 84 in the plastic handle 32. The spring 80 strongly biases the ball 78 towards the various recesses 76. A ball 78 snaps into a particular recess 76 when it is adjacent or proximate to that recess 76. When the ball 78 is engaged with a particular recess 76, the handle 32 has a greater tendency to remain firmly in its position, even during the difficult conditions encountered during fire fighting.

Another of the improvements of the present invention is the plastic material of its handle. This handle is less expensive, and easier to manufacture, than the prior art metal handles. This novel handle is resilient enough to withstand a severe blow, and yet return substantially to its normal shape, without losing its function. Such severe blows could arise in the event that a fire truck were to drive over the fire fighting nozzle, or if the nozzle were dropped directly onto the pavement by its handle.

Plastic handles will, however, contract and expand to a greater degree than metal handles. As a result, if the slot in the plastic handle were of a conventional circular shape, the expansion or contraction of the circular slot in the plastic handle could result in misalignment between the ball and the recesses. In fact, the extent of the misalignment could be sufficient so as to prevent the engagement of the ball with any of the recesses.

To compensate for the expansion or contraction of this plastic handle, the slot in the present invention is an oblong slot 82, 84. When the plastic handle expands or contracts in an upward or downward direction, i.e., along the axis of the arm of the handle 32, the oblong shape of the slot permits upward or downward movement of the ball 78 within the oblong slot 82 or 84. In this way, the ball 78 can "find" the nearest adjacent recess 76.

As may best be seen in FIG. 4, the oblong slot is constructed to permit movement of the ball in a generally upward and downward direction. Because of its oblong shape, and because the lateral (side-to-side) dimension is approximately equal to the diameter of the ball 76, the oblong slot 82, 84 restricts movement of the ball in the lateral or side-to-side direction.

Although the preferred embodiments herein described are sized to coincide with hollow slide valve member 46 having an internal waterway of 1.5 inches, the invention may be made either larger or smaller. The one piece discs may also be made with only one resilient arm, or with more than two arms provided that they develop adequate friction to retain the position of the handle 32. Alternately, other resilient means such as deformable bumps, or looped shaped structures, could be formed to develop suitable friction. These and other modifications may be made without departing from the true spirit and scope of the invention.

What is claimed is:

1. A fire fighting nozzle assembly, comprising:

(a) a hollow receiver section;

(b) a mating bore formed within the hollow receiver section;

(c) a generally cylindrical disc body having a nominal diameter, and a generally smooth perimeter; and (d) resilient, normally outwardly biased arms on the disc body, wherein (i) when the disc body is positioned outside of the confines of the mating bore, at least a portion of the arms extends beyond the nominal diameter of the disc body;

(ii) when the disc body is positioned within the mating bore, the arms are biased outwardly against the periphery of the mating bore, and are biased inwardly by the periphery of the mating bore, and to a position wherein the biasing means are within the nominal diameter of the disc body.

2. The fire fighting nozzle assembly of claim 1, wherein when the one-piece disc is placed within the mating bore, the arms press against the periphery of the mating bore, to ensure a secure, friction fit of the disc body within the mating bore.

3. The fire fighting nozzle of claim 1, wherein the disc body includes a central orifice.

4. The fire fighting nozzle of claim 1, wherein the disc body is made of a plastic material.

5. The fire fighting nozzle of claim 1, wherein the disc body is made of nylon material.

6. The fire fighting nozzle of claim 3, further comprising an internally threaded fastener that is insertable into the central orifice.

7. The fire fighting nozzle of claim 1, further comprising a plurality of recesses in the hollow receiver section, and a plastic handle, the plastic handle including an oblong slot, the oblong slot containing a ball, and further comprising a spring which biases tat ball inwards towards those recesses, the oblong slot being constructed to pennit movement of the ball in a generally upward and downward direction, while restricting movement of the ball in a generally side-to-side direction.

* * * * *